US010508592B2

(12) United States Patent
Jin

(10) Patent No.: US 10,508,592 B2
(45) Date of Patent: Dec. 17, 2019

(54) VGT FOR VEHICLE

(71) Applicants: Hyundai Motor Company, Seoul (KR); Kia Motors Corp., Seoul (KR)

(72) Inventor: Seok Beom Jin, Seongnam-si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 0 days.

(21) Appl. No.: 16/118,983

(22) Filed: Aug. 31, 2018

(65) Prior Publication Data

US 2019/0338698 A1 Nov. 7, 2019

(30) Foreign Application Priority Data

May 4, 2018 (KR) ..... 10-2018-0051748

(51) Int. Cl.

| | |
|---|---|
| ***F02B 37/18*** | (2006.01) |
| ***F02B 37/24*** | (2006.01) |
| ***F01D 9/04*** | (2006.01) |
| ***F01D 17/16*** | (2006.01) |

(52) U.S. Cl.

CPC ..... *F02B 37/183* (2013.01); *F01D 9/041* (2013.01); *F01D 9/048* (2013.01); *F01D 17/165* (2013.01); *F02B 37/24* (2013.01); *F05D 2220/40* (2013.01); *F05D 2240/128* (2013.01); *F05D 2240/14* (2013.01); *F05D 2260/85* (2013.01)

(58) Field of Classification Search

CPC ..... F02B 37/18; F02B 37/183; F02B 37/186; F02B 37/22; F02B 37/24; F01D 9/041; F01D 9/048; F01D 9/047; F01D 17/165; F05D 2240/128

USPC ..... 60/602, 603

See application file for complete search history.

(56) References Cited

U.S. PATENT DOCUMENTS

| | | | | |
|---|---|---|---|---|
| 7,810,327 | B2 * | 10/2010 | Parker | F01D 17/141 415/158 |
| 8,191,368 | B2 * | 6/2012 | Garrett | F01D 17/143 415/157 |
| 9,739,166 | B1 * | 8/2017 | King | F01D 5/043 |
| 2003/0014972 | A1 * | 1/2003 | Arnold | F01D 5/141 60/602 |

(Continued)

FOREIGN PATENT DOCUMENTS

| | | | | |
|---|---|---|---|---|
| DE | 102011120880 | A1 * | 6/2013 | |
| EP | 1433937 | A1 * | 6/2004 | F01D 17/10 |

(Continued)

*Primary Examiner* — Mark A Laurenzi
*Assistant Examiner* — Mickey H France
(74) *Attorney, Agent, or Firm* — Morgan, Lewis & Bockius LLP

(57) ABSTRACT

A variable geometry turbocharger (VGT) for a vehicle, may include a turbine wheel; a turbine housing configured to rotatably support the turbine wheel, and provided with a passage for receiving exhaust gas from a radially external side of the turbine wheel and discharging the exhaust gas in an axial direction of the turbine wheel; a disk body provided in the passage of the turbine housing, and provided therein with a bypass line such that the exhaust gas bypasses the turbine wheel; and a plurality of vanes provided between the disk body and the turbine housing to form a variable nozzle for controlling a flow of the exhaust gas flowing radially inwardly of the turbine wheel.

7 Claims, 9 Drawing Sheets

(56) References Cited

U.S. PATENT DOCUMENTS

| | | | | |
|---|---|---|---|---|
| 2004/0096317 | A1* | 5/2004 | Scholz | F01D 17/165<br>415/160 |
| 2005/0060999 | A1* | 3/2005 | Mulloy | F01D 17/14<br>60/602 |
| 2016/0326951 | A1* | 11/2016 | Groves | F02B 37/24 |

FOREIGN PATENT DOCUMENTS

| | | | | |
|---|---|---|---|---|
| EP | 2 937 521 | A1 | 10/2015 | |
| EP | 3 103 988 | B1 | 12/2017 | |
| WO | WO-2010058788 | A1 * | 5/2010 | F01D 17/143 |

* cited by examiner

VGT FOR VEHICLE

CROSS REFERENCE TO RELATED APPLICATION

The present application claims priority to Korean Patent Application No. 10-2018-0051748, filed May 4, 2018, the entire contents of which is incorporated herein for all purposes by this reference.

BACKGROUND OF THE INVENTION

Field of the Invention

The present invention relates generally to a variable geometry turbocharger (VGT) for a vehicle. More particularly, the present invention relates to a technology for a VGT structure.

Description of Related Art

A VGT of a vehicle changes the flow of exhaust gas entering a turbine wheel by adjusting an angle of vanes to actively cope with changes in operating conditions of an engine, whereby it is possible to provide a supercharging performance suitable for the entire engine operation region such by as reducing the turbo lag in the low load region to increase responsiveness.

Meanwhile, a catalyst for purifying harmful substances in the exhaust gas may rapidly reach the light-off temperature (LOT) when cold-starting an engine, to ensure proper purification performance, and the temperature rise of the catalyst is entirely due to the energy delivered from the exhaust gas. However, a vehicle provided with a conventional VGT is problematic in that since the exhaust gas is supplied to the catalyst only through the turbine wheel, even if the vanes are fully opened, the exhaust gas reaches the catalyst in the state where the energy thereof is reduced to some extent by the turbine wheel, and thus the temperature rise of the catalyst is relatively slow compared to the case where the exhaust gas is supplied directly to the catalyst without going through the turbine wheel.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a VGT for a vehicle, the VGT being configured to properly adjust the angle of the vanes according to each operation region in all the operation regions of the engine, and also allow the exhaust gas to directly heat the catalyst by bypassing the turbine wheel only by adjusting the angle of the vanes at an initial stage of cold-starting of the engine, whereby it is possible to maximize the purification performance for removal of in the exhaust gas at the initial stage of cold-start of engine by rapid catalyst activation.

In various aspects of the present invention, there is provided a variable geometry turbocharger (VGT) for a vehicle, the VGT including: a turbine wheel; a turbine housing configured to rotatably support the turbine wheel, and provided with a space 10 for forming a passage for receiving exhaust gas from a radially external side of the turbine wheel and discharging the exhaust gas in an axial direction of the turbine wheel; a disk body provided in the passage of the turbine housing, and provided therein with a bypass line such that the exhaust gas bypasses the turbine wheel; and a plurality of vanes provided between the disk body and the turbine housing to form a variable nozzle for controlling a flow of the exhaust gas flowing radially inwardly of the turbine wheel, wherein each of the vanes has a length such that a fore end portion thereof is brought in contact with a neighboring vane, being rotatable while fully closing the variable nozzle, and an inlet of the bypass line of the disk body is configured to be opened only when the vanes are rotated to fully close the variable nozzle.

The vanes may be provided to be rotatable with respect to the disk body about a rotation axis parallel with the axial direction of the turbine wheel, and each of the vanes is integrally provided with a side guide configured to open or close the inlet of the bypass line while maintaining surface-contact with the disk body when rotated.

The side guide of each of the vanes may be formed in a plate shape integrally protruding radially with respect to a rotation axis of the vanes, to minimize cross-sectional area reduction of the variable nozzle formed by the vanes.

The inlet of the bypass line of the disk body may be formed in a fan shape centering on a rotation center of the vanes.

The disk body may include: a disk portion brought in contact with a side of each of the vanes to form a portion of the variable nozzle, and provided with the inlet of the bypass line; and a hollow portion integrally connected to the disk portion, configured such that the exhaust gas passing through the turbine wheel passes through a center internal bore, and provided with an outlet of the bypass line.

A portion where the disk portion and the hollow portion are connected may be formed to have a cross-sectional shape forming a predetermined air gap with a spatial trajectory formed when a turbine blade of the turbine wheel is rotated, and the air gap may be minimized within a range preventing interference between the turbine blade and the disk body.

The vanes may be configured to be rotated by operation of an actuator, the actuator may be configured to be controlled by operation of a controller, and the controller may be configured to control the actuator when cold-starting an engine such that the variable nozzle is fully closed and the inlet of the bypass line is fully opened.

According to an exemplary embodiment of the present invention, it is possible to properly adjust the angle of the vanes according to each operation region in all the operation regions of the engine, and also it is possible to allow the exhaust gas to directly heat the catalyst by bypassing the turbine wheel only by adjusting the angle of the vanes at an initial stage of cold-starting of the engine, whereby it is possible to maximize the purification performance for removal of harmful substances in the exhaust gas at the initial stage of cold-start of engine by rapid catalyst activation.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
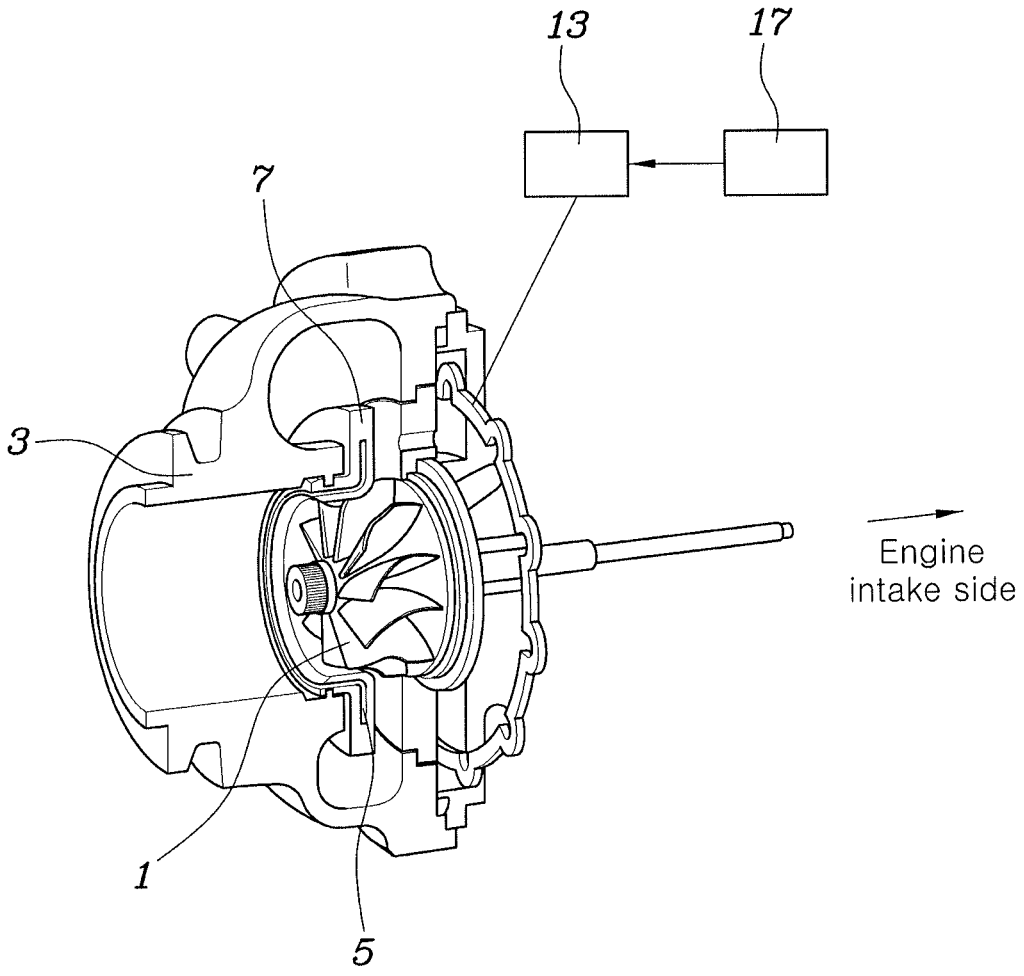
FIG. 1 is a sectional view showing a VGT for a vehicle according to an exemplary embodiment of the present invention.
Figure 2:
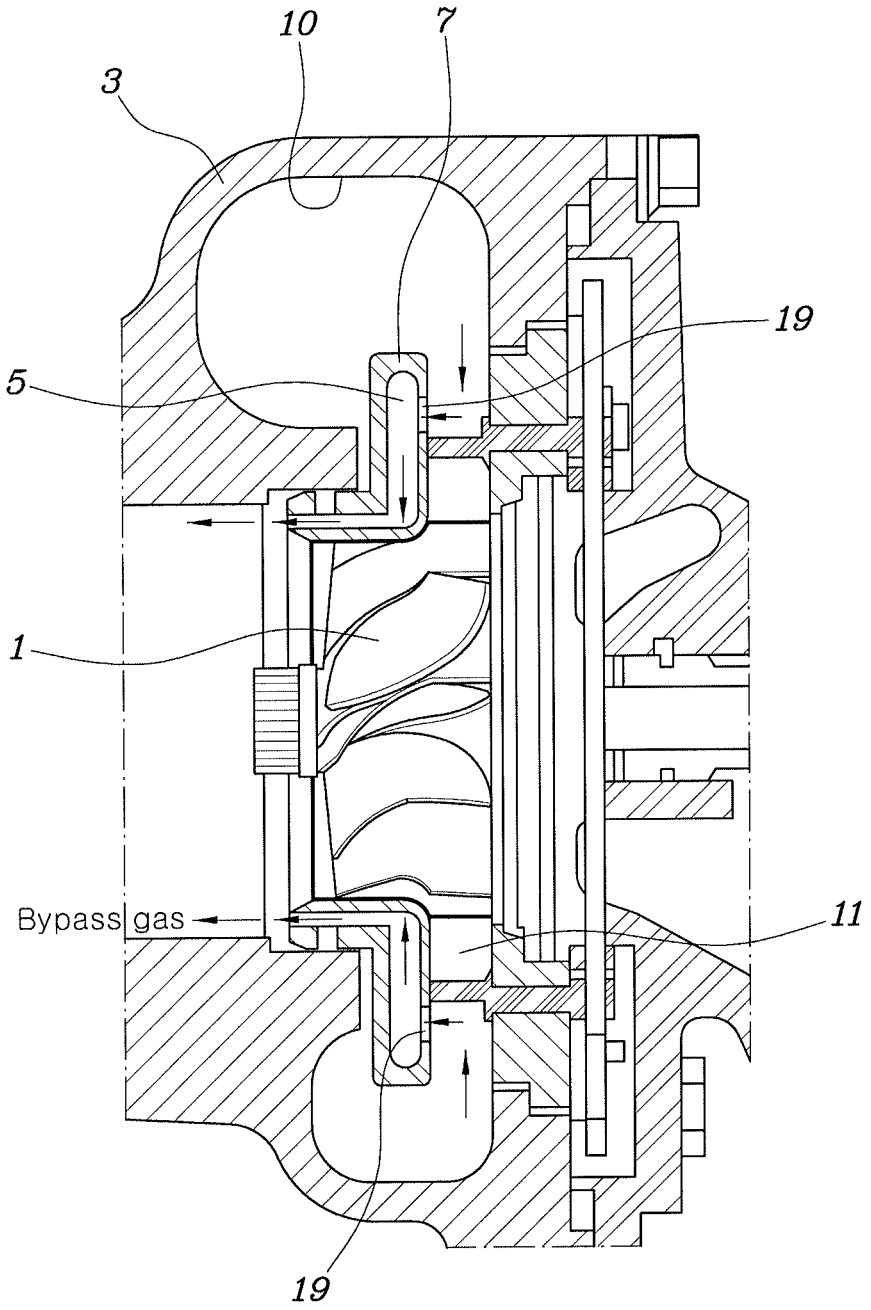
FIG. 2 is a detailed view of important parts of FIG. 1.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the other hand, the invention(s) is/are intended to cover not only the exemplary embodiments of the present invention, but also various alternatives, modifications, equivalents and other embodiments, which may be included within the spirit and scope of the invention as defined by the appended claims.

Hereinbelow, an exemplary embodiment of the present invention will be described in more detail with reference to the accompanying drawings.

Referring to FIGS. 1 to 10, a variable geometry turbocharger (VGT) for a vehicle according to an exemplary embodiment of the present invention may include: a turbine wheel 1; a turbine housing 3 configured to rotatably support the turbine wheel 1, and provided with a passage for receiving exhaust gas from a radially external side of turbine wheel 1 and discharging the exhaust gas in an axial direction of the turbine wheel 1; a disk body 7 provided in the passage of the turbine housing 3, and provided therein with a bypass line 5 such that the exhaust gas bypasses the turbine wheel 1; and a plurality of vanes 11 between the disk body 7 and the turbine housing 3 to form a variable nozzle 9 for controlling a flow of the exhaust gas flowing radially inwardly of the turbine wheel 1.

Each of the vanes 11 has a length such that a fore end portion thereof is brought in contact with a neighboring vane 11, being rotatable while fully closing the variable nozzle 9, and an inlet of the bypass line 5 of the disk body 7 is configured to be opened only when the vanes 11 are rotated to fully close the variable nozzle 9.

The vanes 11 linked to a unison ring 15 via a connection link 34 are configured to be rotated along with the unison ring 15 rotated by a separate actuator 13 to adjust an opening cross-sectional area and an angle of the variable nozzle 9, wherein the actuator 13 is controlled by a controller 17 that generates a control signal in accordance with the operating state of the engine.

In other words, the vanes 11 are configured to be rotated by an operation of the actuator 13, the actuator 13 is configured to be controlled by operation of the controller 17, the controller 17 is configured to control the actuator 13 when cold-starting the engine such that the variable nozzle 9 is fully closed and the inlet of the bypass line 5 is fully opened, and the opening cross-sectional area and the angle of the variable nozzle 9 are adjusted by changing the rotation angle of the vanes 11 in situations where engine supercharging is required.

Herein, the variable nozzle 9 represents a passage of the exhaust gas formed by two neighboring vanes 11 and the surfaces provided by the turbine housing 3 and disk body 7, which form both sides of the two neighboring vanes 11, and the opening cross-sectional area and the angle of the variable nozzle 9 are adjusted according to the rotation of the vanes 11 by the unison ring 15.

The vanes 11 are provided to be rotatable with respect to the disk body 7 about a rotation axis parallel with the axial direction of the turbine wheel 1, and each of the vanes 11 rotatably coupled to a coupling hole 30 formed on the disk body 7 is integrally provided with a side guide 21 configured to open or close the inlet 19 of the bypass line 5 while maintaining surface-contact with the disk body 7 when rotated.

Figure 8:
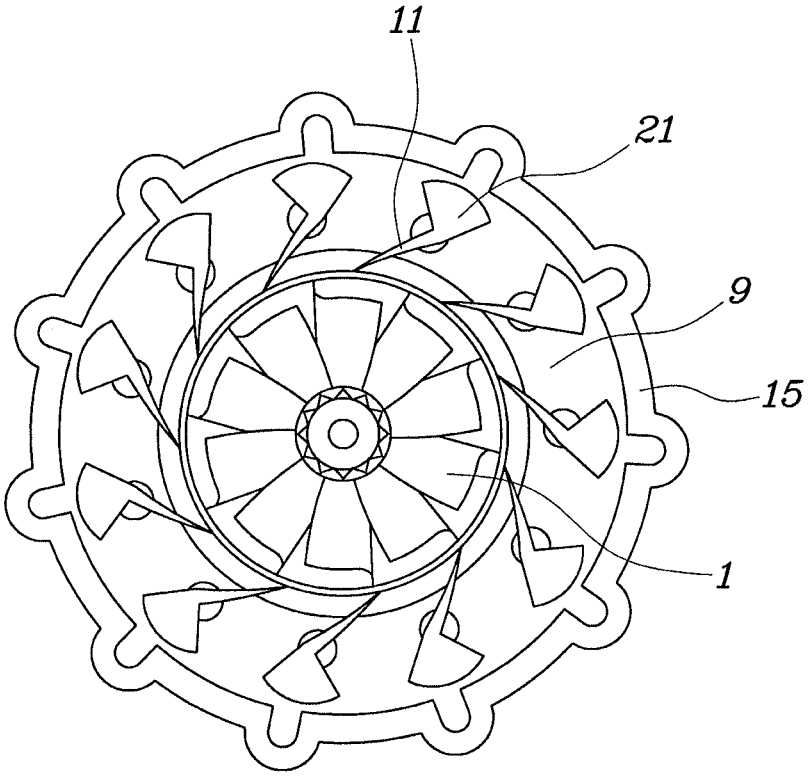
FIG. 8 is a view showing a state where the VGT of FIG. 1 operates vanes in the closing direction as much as possible within a normal operating range.
Figure 9:
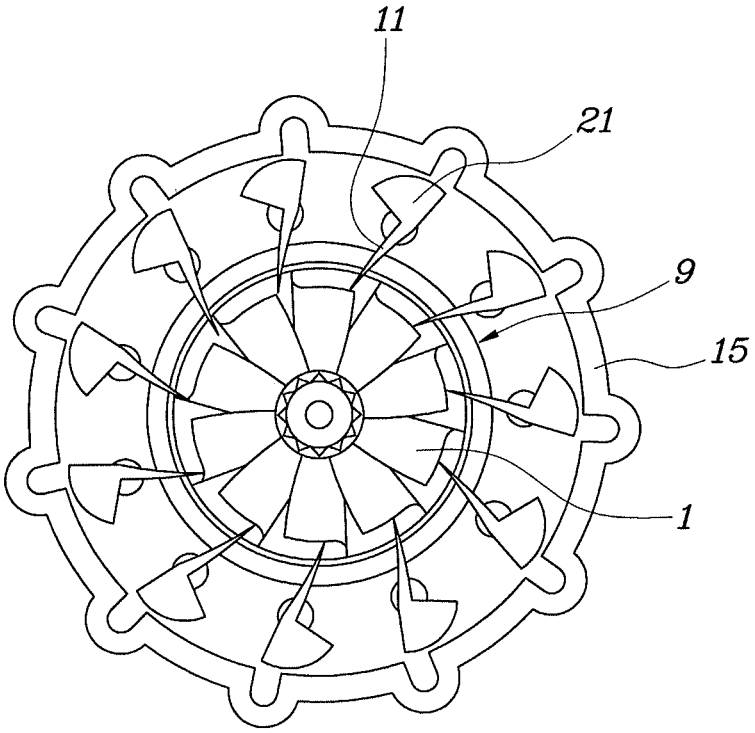
FIG. 9 is a view showing a state where the VGT of FIG. 1 operates vanes in the opening direction as much as possible within a normal operating range.
Figure 10:
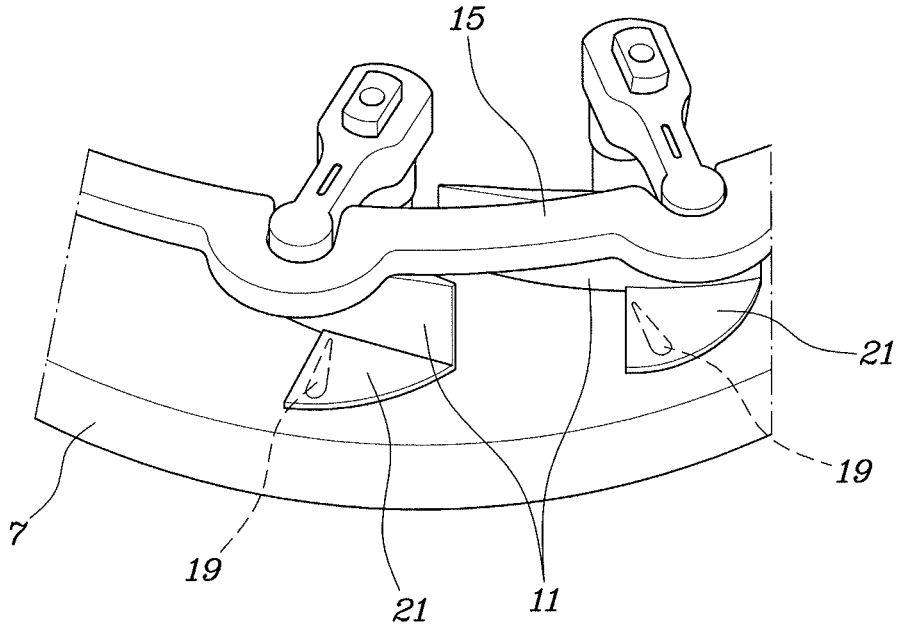
FIG. 10 is a view showing a state where an inlet of a bypass line is closed by a side guide within the normal operation range of VGT as shown in FIG. 8 or FIG. 9.

Accordingly, as shown in FIG. 8 and FIG. 9, within a normal operation range of the VGT, the side guide 21 tightly closes the inlet 19 of the bypass line 5, and thus all the exhaust gas is discharged through the variable nozzle 9 via the turbine wheel 1.

For reference, FIG. 8 and FIG. 9 show a state where the VGT of FIG. 1 performs a general operation as VGT without implementing a bypass function, wherein FIG. 8 is a view showing a state where the VGT operates the vanes 11 in the closing direction as much as possible within a normal operating range; and FIG. 9 is a view showing a state where the VGT operates the vanes 11 in the opening direction as much as possible within a normal operating range.

The side guide 21 of the vane 11 is formed in a plate shape integrally protruding radially with respect to a rotation axis of the vanes 11, to minimize cross-sectional area reduction of the variable nozzle 9 formed by the vanes 11.

Meanwhile, the inlet 19 of the bypass line 5 of the disk body 7 is formed in a fan shape centering on a rotation center of the vanes 11 such that the maximum opening area is opened or closed for the same rotational displacement of the side guide 21.

Figure 6:
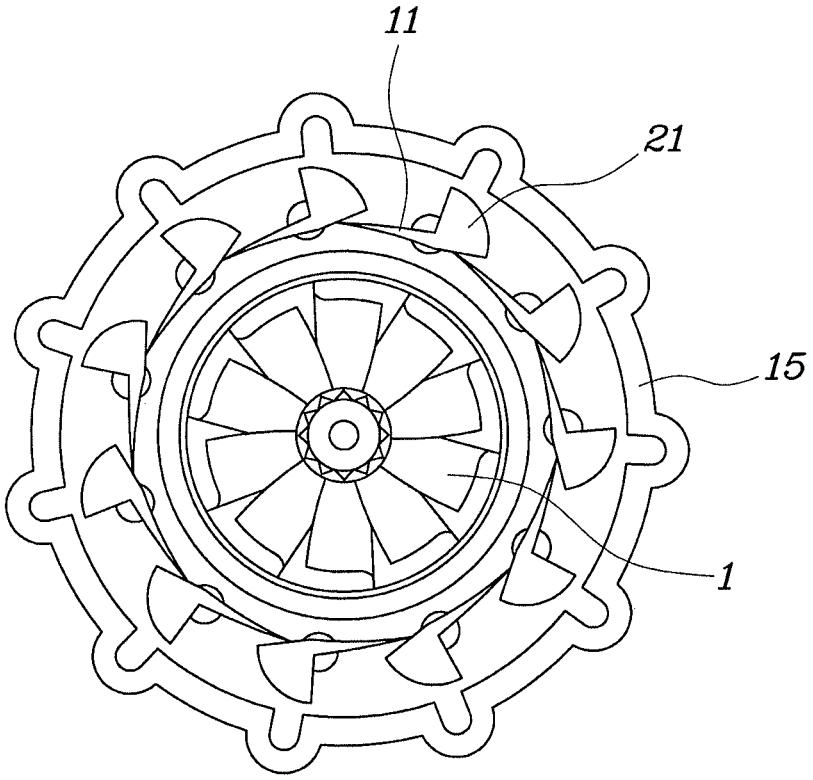
FIG. 6 is a view showing a state where vanes of FIG. 1 completely close a variable nozzle.
Figure 7:
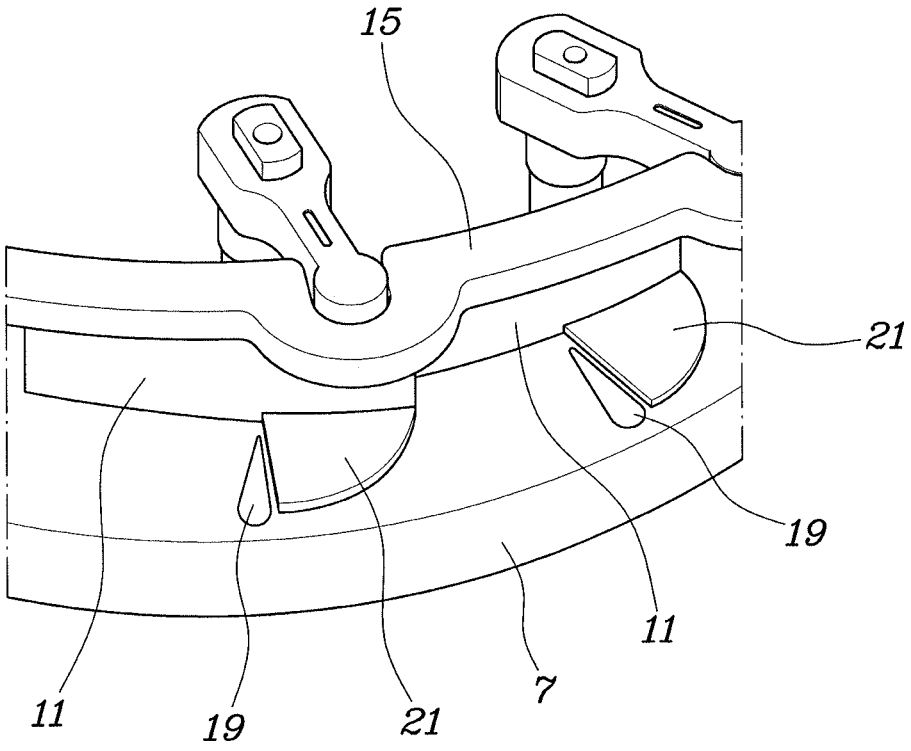
FIG. 7 is a view showing a state where an inlet of a bypass line is opened in the state of FIG. 6.

Accordingly, as in FIG. 8 and FIG. 9, in the normal operation range of VGT, the inlet 19 of the bypass line 5 is maintained fully closed by the side guide 21, and as in FIG. 6 and FIG. 7, in the state where the vanes 11 fully close the variable nozzle 9, the opening area of the inlet 19 of the bypass line 5 is maximized such that the exhaust gas bypasses the turbine wheel 1 and moves directly to the catalyst, effectively shortening the temperature rise time of the catalyst.

Figure 3:
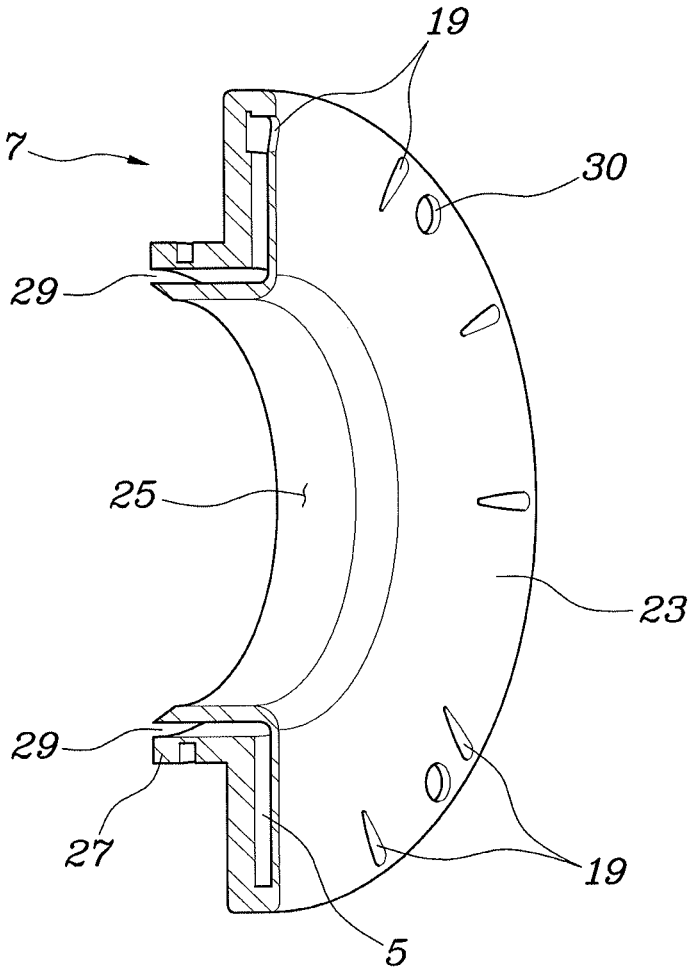
FIG. 3 is a view showing a configuration of a disk body of FIG. 1.
Figure 4:
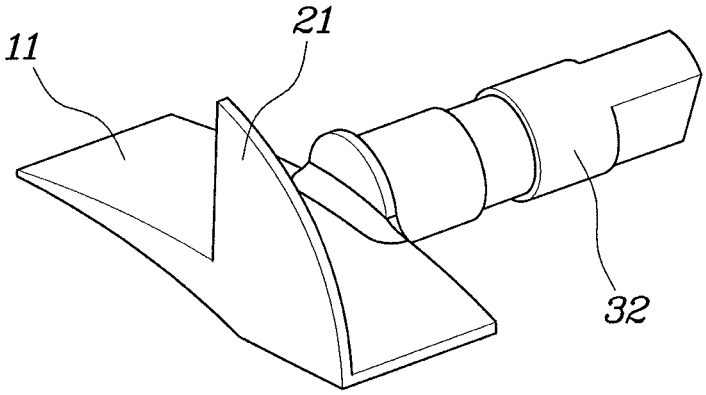
FIG. 4 is a detailed view showing a vane of FIG. 1.
Figure 5:
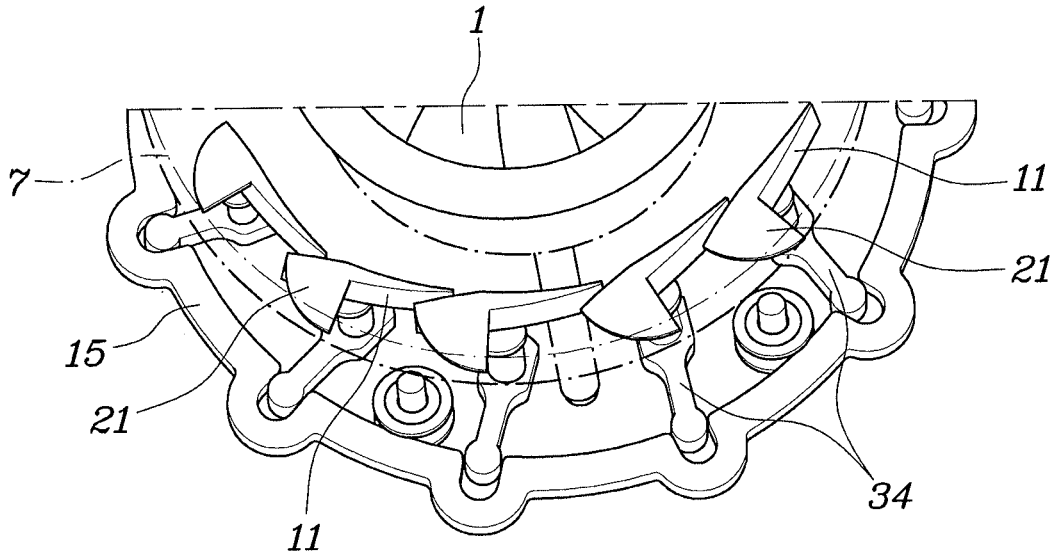
FIG. 5 is a view showing important parts of the configuration of the present invention of FIG. 1 from a turbine outlet side.

Referring to FIG. 3, the disk body 7 includes: a disk portion 23 brought in contact with a side of each of the vanes 11 while a shaft 32 of the vanes 11 is rotatably connected to a coupling hole 30 formed on the disk portion 23, to form a portion of the variable nozzle 9, and provided with the inlet 19 of the bypass line 5; and a hollow portion 27 integrally connected to the disk portion 23, configured such that the exhaust gas passing through the turbine wheel 1 passes through a center internal bore 25, and provided with an outlet 29 of the bypass line 5.

A portion where the disk portion 23 and the hollow portion 27 of disk body 7 are connected is formed to have a cross-sectional shape forming a predetermined air gap with a spatial trajectory formed when a turbine blade of the turbine wheel 1 is rotated, and the air gap is minimized within a range preventing interference between the turbine blade and the disk body 7, such that the exhaust gas entering through the variable nozzle 9 is fully used to drive turbine wheel 1.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable geometry turbocharger (VGT) for a vehicle, the VGT comprising:

a turbine wheel;

a turbine housing configured to rotatably support the turbine wheel, and provided with a space for forming a passage for receiving exhaust gas from a radially external side of the turbine wheel and discharging the exhaust gas in an axial direction of the turbine wheel;

a disk body provided in the space of the turbine housing, and provided therein with a bypass line wherein the exhaust gas bypasses the turbine wheel through the bypass line; and a plurality of vanes mounted between the disk body and the turbine housing to form a variable nozzle and controlling a flow of the exhaust gas flowing radially inwardly of the turbine wheel, wherein each of the vanes has a length such that a fore end portion thereof is brought in contact with an adjacent vane among the vanes, while fully closing the variable nozzle, and wherein an inlet of the bypass line of the disk body is formed on a side of the disk body and configured to be opened by the vanes when the vanes are rotated to fully close the variable nozzle, to fluidically connect the bypass line to the space of the turbine housing.

2. The VGT of claim 1, wherein the vanes are provided to be rotatable with respect to the disk body about a rotation axis of the vanes in parallel with the axial direction of the turbine wheel, and wherein each of the vanes is integrally provided with a side guide configured to open or close the inlet of the bypass line while maintaining contact with the disk body when each of the vanes is rotated.

3. The VGT of claim 2, wherein the side guide of each of the vanes is formed in a plate shape integrally protruding radially with respect to the rotation axis of the vanes, to minimize cross-sectional area reduction of the variable nozzle formed by the vanes.

4. The VGT of claim 2, wherein the inlet of the bypass line of the disk body is formed in a fan shape centering on the rotation axis of the vanes.

5. The VGT of claim 2, wherein the disk body includes:

a disk portion to which a side of each of the vanes is rotatably coupled to form a portion of the variable nozzle, and provided with the inlet of the bypass line; and a hollow portion integrally connected to an end portion of the disk portion to form the bypass line between the disk portion and the hollow portion, wherein the exhaust gas passing through the turbine wheel from the space of the turbine housing passes through a center internal bore of the hollow portion, and wherein an outlet of the bypass line is formed between the disk portion and the hollow portion.

6. The VGT of claim 5, wherein a portion where the disk portion and the hollow portion are connected is formed to have a cross-sectional shape forming a predetermined air gap with a spatial trajectory formed when a turbine blade of the turbine wheel is rotated, and wherein the air gap is configured to be minimized within a range preventing interference between the turbine blade and the disk body.

7. The VGT of claim 2, wherein the vanes coupled to an actuator are rotated by operation of the actuator, wherein the actuator is controlled by operation of a controller connected to the actuator, and wherein the controller is configured to control the actuator when cold-starting an engine such that the variable nozzle is fully closed and the inlet of the bypass line is fully opened.

* * * * *